United States Patent [19]

Kim

[11] Patent Number: 4,597,269

[45] Date of Patent: Jul. 1, 1986

[54] PLASTIC PAN HAVING A REFRIGERATOR SUPPORT

[76] Inventor: Il Y. Kim, 2915 Wickersham Way, T-2, Falls Church, Va. 22042

[21] Appl. No.: 652,589

[22] Filed: Sep. 20, 1984

[51] Int. Cl.[4] ..... F25D 21/14

[52] U.S. Cl. ..... 62/286; 62/272

[58] Field of Search ..... 62/285, 286, 289, 288, 62/272; 248/274, 282, 295.1, 318

[56] References Cited

U.S. PATENT DOCUMENTS 3,491,550 1/1970 Cavis ..... 62/285

*Primary Examiner*—Henry Bennett

*Attorney, Agent, or Firm*—Birch, Stewart, Kolasch & Birch

[57] ABSTRACT

A primary pan assembly adapted to be mounted to the motor of an air conditioning system which comprises a primary pan provided with a drainage hole on at least one side thereof and stud members extending from the bottom thereof, a support bracket disposed to support the primary pan, height-adjustable brackets operatively connected with said support bracket at opposite end portions thereof for varying the height of said height-adjustable brackets relative to each other, said height-adjustable brackets containing apertures for slidably receiving the stud members of said primary pan, and a motor mount bracket for mounting the pan assembly to the motor, said motor mount bracket containing means for mounting the support bracket to said motor mount.

9 Claims, 9 Drawing Figures

PLASTIC PAN HAVING A REFRIGERATOR SUPPORT

BACKGROUND AND SUMMARY OF THE INVENTION

The present invention relates to a primary pan assembly for use in conjunction with air conditioning installations and refrigeration systems, and more particularly, to a plastic primary pan assembly having a support structure which is mounted to a motor.

Primary pans are known which are utilized with air conditioning systems. These prior art devices utilize a primary pan made of steel which is directly mounted to the fan motor. However, there are many problems with the prior art devices, that is, (1) the metallic primary pans eventually become rusted and plug up the outlet for draining water from the pan; (2) it is difficult for the pan to support the air conditioning system because of the additional weight caused by the metal pan; and (3) electronic leakage is developed because the primary pan and the hanger for the motor are made of a metal which, when in contact with the wires from the motor, contributes to said leakage.

OBJECTS AND SUMMARY OF THE INVENTION

Accordingly, it is an object of the present invention to provide an improved plastic primary pan used in conjunction with an air conditioning system.

Another object of the present invention is to provide an improved primary pan which is structured for draining condensate water through an outlet and avoiding the plugging up of the outlet.

Still another object of the present invention is to provide an air conditioning system with an assembly for mounting a primary pan to a motor.

A further object of the present invention is to provide an aluminum support which has L-shaped or C-shaped configurations for housing electrical wires, thereby substantially eliminating electrical leakage.

Other objects and further scope of applicability of the present invention will become apparent from the detailed description given hereinafter. It should be understood, however that the detailed description and specific examples, while indicating preferred embodiments of the invention, are given by way of illustration only, since various changes and modifications within the spirit and scope of the invention will become apparent to those skilled in the art from this detailed description.

The present invention comprises a plastic primary pan assembly for use in conjunction with an air conditioning system, wherein an aluminum support bracket is utilized to support a plastic pan utilizing height adjustable brackets. The support bracket is, in turn, mounted on the motor utilizing a motor mount bracket.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE DRAWINGS

Figure 1:
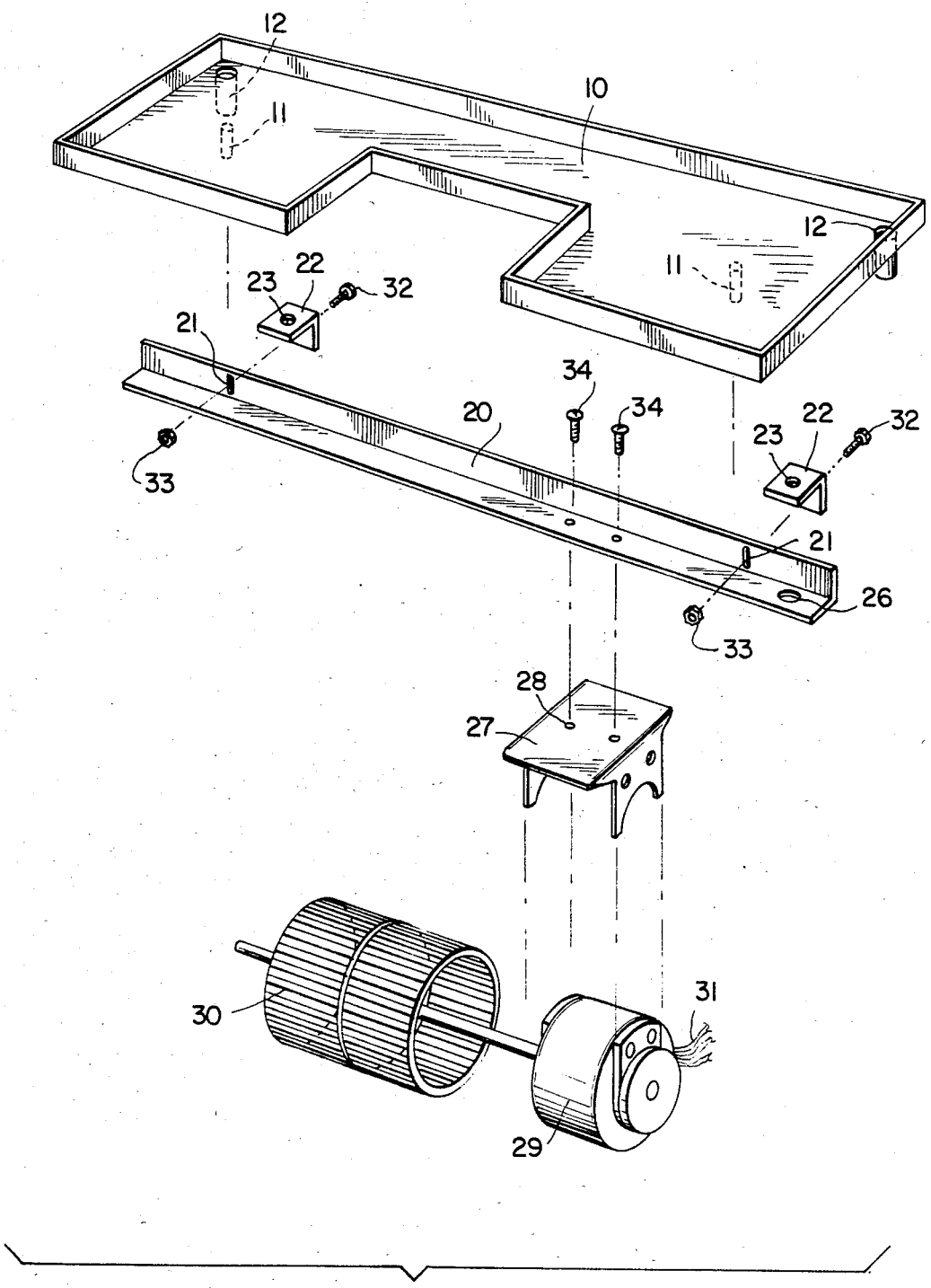
FIG. 1 is an exploded perspective view showing the basic components of a primary pan with its associated support elements as defined by the present invention.

Referring now in detail to the drawings for the purpose of illustrating the present invention, the primary pan and support elements, as shown in the figures comprise a plastic primary pan 10, a support bracket 20, and a motor mount bracket 27 which is mounted to a motor 29. The plastic primary pan 10 is provided with connecting studs 11 which slidably fit into holes 23 of height adjustable brackets 22 which are attached to the support bracket 20 through slots 21 and holes 24 utilizing screws 32. Thus the pan 10 can be canted to either the left or the right side by raising or lowering the brackets 22 sliding along slots 21. In this manner, water which collects in the pan can be drained from either side thereof through drain holes 12.

The pan 10 is made of plastic to eliminate the formation of rust which, in the prior art devices, accumulates in the pan and tends to clog up the water drain holes 12.

Figure 4:
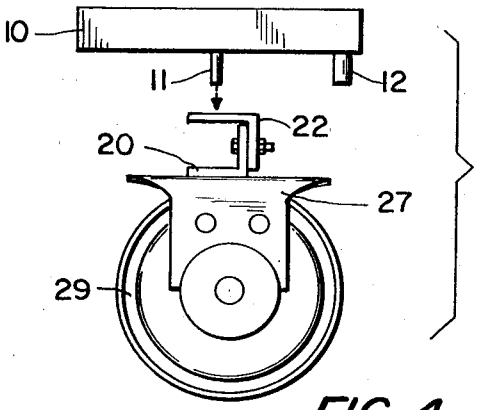
FIG. 4 is an end view showing the primary pan supported by motor mount elements.
Figure 2:
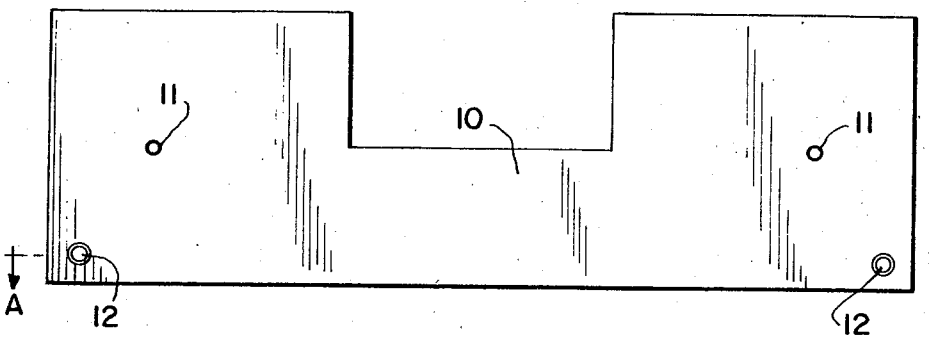
FIG. 2 is a bottom view of the primary pan of the present invention.
Figure 8:
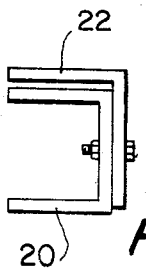
FIG. 8 is another embodiment of the height adjustable support element having a C-shaped configuration.
Figure 9:
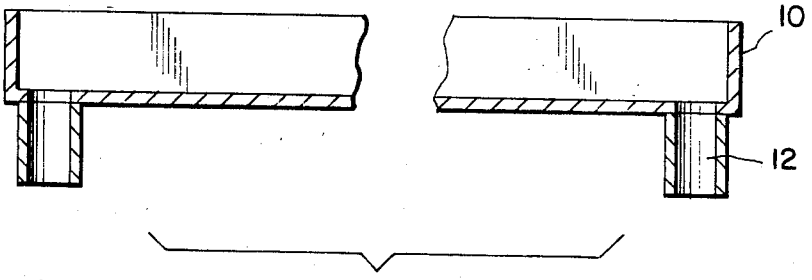
FIG. 9 is a sectional view of the primary pan taken along line A—A of FIG. 2.

The support bracket is made of aluminum or hard plastic and can have, for example, an L-shaped or C-shaped configuration as shown in FIGS. 4 and 8, respectively. As stated above, the support bracket has slots 21 for adjusting the height of the height adjustable brackets 22, holes 25 and screws 34 for mounting the support bracket to the motor mount bracket 27 through holes 28 and which, in turn, is mounted to motor 29, and a hole 26 for transferring electrical wires 31 from the motor 29 to a protected area defined by the L-shaped or C-shaped support member 20. The height-adjustable brackets 22 are provided with bolts 32 and nuts 33 which cooperate with the slots for adjusting the inclination of the pan.

The motor mount bracket 27 is mounted on the motor 29 and supports the support bracket 20 utilizing bolts 34 and holes 25 and 28 disposed in the support bracket and motor mount bracket, respectively.

Figure 3:
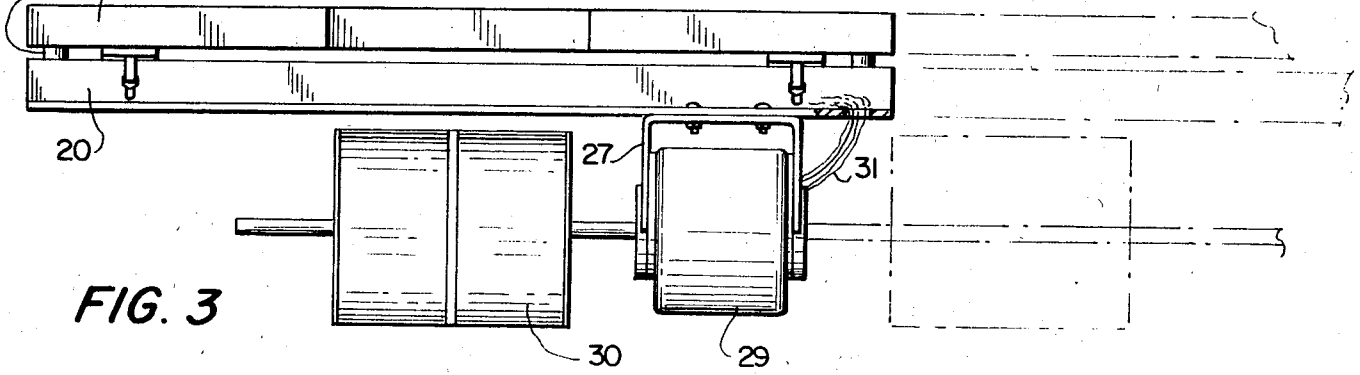
FIG. 3 is a side view of the primary pan supported by motor mount elements of the present invention.
Figure 5:
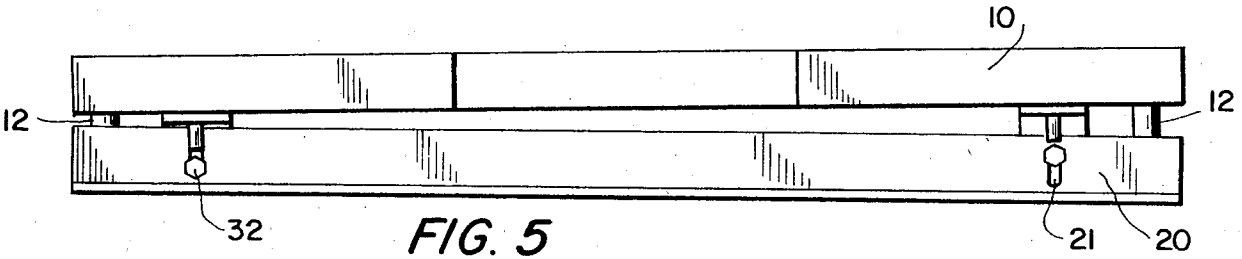
FIG. 5 is a front view showing how the primary pan can be sloped to facilitate water drainage.
Figure 6:
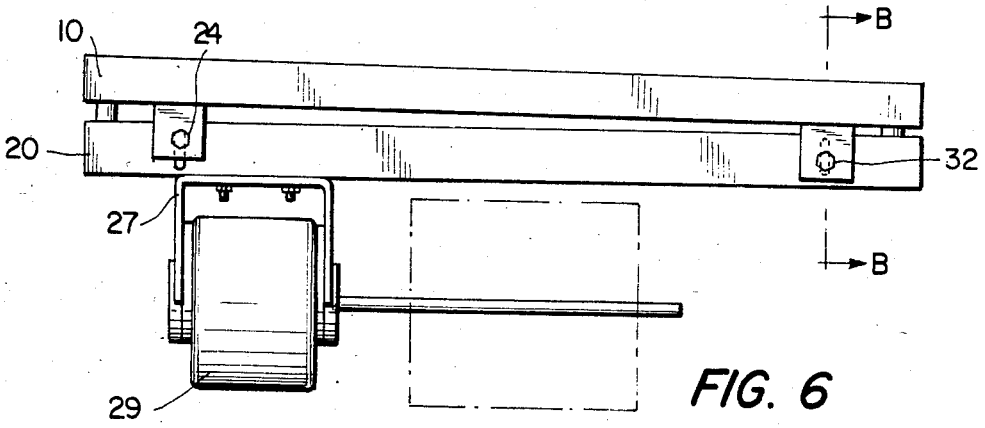
FIG. 6 is a rear side view of the primary pan mounted in position on a motor.
Figure 7:
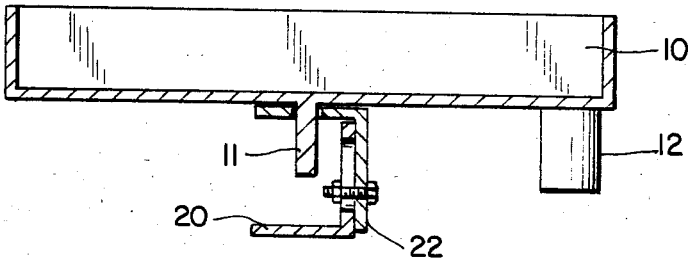
FIG. 7 is a sectional view taken along line B—B of the primary pan of FIG. 6.

The primary pan assembly as shown in FIG. 1 can extend over the fan or if two fans are present, as shown in phantom in FIG. 3, the pan 30 can be extended across both fans. Also, when adjusting the drain angle of the pan, to the left (see FIG. 5) or the right, the pan can also be canted toward the front merely by mechanically manipulating the pan with the hands and fixing the pan in position with the nuts 33 and bolts 32. This facilitates the drainage of water from the pan through the drain holes 12.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A primary pan assembly adapted to be mounted to the motor of an air conditioning system which comprises a primary pan provided with a drainage hole on at least on side thereof and stud members extending from the bottom thereof, a support bracket disposed to support the primary pan, height-adjustable brackets operatively connected with said support bracket at opposite end portions thereof for varying the height of said height-adjustable brackets relative to each other, said height-adjustable brackets containing apertures for slidably receiving the stud members of said primary pan, and a motor mount bracket for mounting the pan assembly to the motor, said motor mount bracket containing means for mounting the support bracket to said motor mount.

2. The primary pan assembly of claim 1 wherein the support bracket is L-shaped members provided with slots for varying the position of the height-adjustable brackets within said slots.

3. The primary pan assembly of claim 1 wherein the primary pan is made of a plastic material.

4. The primary pan assembly of claim 1 wherein the support bracket is made of a plastic material.

5. The primary pan assembly of claim 1 wherein said assembly extends over the motor and the fan of the air conditioning system.

6. The primary pan assembly of claim 2 wherein the wires for the motor extend from the motor and are housed by the support bracket.

7. The primary pan assembly of claim 1 wherein the support bracket is C-shaped members are provided with slots for verying the position of the height-adjustable brackets within said slots.

8. The primary pan assembly of claim 7 wherein the wires for the motor extend from the motor and are housed by the support bracket.

9. The primary pan assembly of claim 1 wherein the support bracket is made of aluminum.

* * * * *